United States Patent [19]

Satake

[11] 4,318,806

[45] Mar. 9, 1982

[54] AUTOMATIC CONTROL APPARATUS FOR A GRAIN SEPARATOR

[75] Inventor: Toshihiko Satake, Higashihiroshima, Japan

[73] Assignee: Satake Engineering Co., Ltd., Tokyo, Japan

[21] Appl. No.: 190,762

[22] PCT Filed: Apr. 5, 1979

[86] PCT No.: PCT/SP79/00088

§ 371 Date: Feb. 29, 1980

§ 102(e) Date: Feb. 1, 1980

[87] PCT Pub. No.: WO80/00132

PCT Pub. Date: Feb. 7, 1980

[30] Foreign Application Priority Data

Jun. 30, 1978 [JP] Japan ..... 53/80111
Aug. 3, 1978 [JP] Japan ..... 53195617

[51] Int. Cl.[3] ..... B03B 4/00; B03B 13/02

[52] U.S. Cl. ..... 209/496; 209/467; 209/491

[58] Field of Search ..... 209/466–469, 209/471, 472, 479–481, 490, 491, 494–496, 577, 580, 581, 587, 635, 691, 694, 695

[56] References Cited

U.S. PATENT DOCUMENTS

| | | | |
|---|---|---|---|
| 440,460 | 11/1890 | Boone et al. | 209/479 |
| 2,150,103 | 3/1939 | Peale | 209/469 |
| 3,933,249 | 1/1976 | Welsh et al. | 209/441 X |
| 4,149,967 | 4/1979 | Masumoto | 209/467 |

*Primary Examiner*—Ralph J. Hill
*Attorney, Agent, or Firm*—Lowe, King, Price & Becker

[57] ABSTRACT

An automatic control apparatus of a grain separator for precisely separating a mixture of soil particles and grain having different hue and specific gravity, wherein the grain separator includes a soil discharge opening disposed at the front end of a separating plate which is inclined with a forward elevation in order to perform oscillations back and forth at a larger angle than said inclined angle, and a grain discharge opening disposed at the rear end thereof.

The automatic control apparatus is equipped with a light source and a light receiving element at the front end of said separating plate to detect the intensity of the ray reflected from the mixture of soil and grain, at which said light receiving element produces a signal which actuates an electromagnetic driving means to allow or block the discharge of materials from the soil discharge opening, thus discharging only soil particles from the discharge opening.

3 Claims, 9 Drawing Figures

AUTOMATIC CONTROL APPARATUS FOR A GRAIN SEPARATOR

DESCRIPTION

1. Technical Field

This invention relates to an automatic control apparatus for a grain separator which separates soil particles from grain.

2. Background Art

An already known grain separator has a separating plate held in an inclined position and which oscillates back and forth to supply a mixture of soil particles and grain onto said separating plate, whereby only the soil particles concentrated in a front region of the plate are discharged through a soil discharge opening and the grain, free of soil particles, is discharged through a discharged opening in the rear end of the separating plate.

However, even though soil and grain may be generally separated from each other on a separating plate, that is, on a rough separating section of such a grain separator, it is difficult to separate out only the soil particles and a great amount of grain is still mixed with the separated soil particles so that the soil has to be further separated from the grain.

Even if such an apparatus is further provided with a re-separating means, that is, a cleaning section for precisely withdrawing only the soil particles in a discharge section, it is practically impossible to provide refined separation because soil containing a great amount of grain is discharged whenever the flow of the mixture is changed or whenever the proportion of the soil is considerably changed.

DISCLOSURE OF THE INVENTION

This invention relates to an automatic control apparatus of a grain separator for precisely separating a mixture of soil particles, such as fine stones and sand, from grain of different hues and specific gravities.

A first object of this invention is to provide an automatic control apparatus of a grain separator for precisely separating soil particles from grain by means of a valve which operates in conjunction with a photoelectric means set in a front end of the separating plate to facilitate this separation, making reseparation unnecessary and thus promoting operating efficiency and saving labor.

In order to accomplish the above mentioned object, this invention relates to a grain separator in which a separating plate, separating a mixture of soil and grain having different hues and specific gravities, is inclined with the front of the plate in an elevated position and is oscillated. The separator is provided with a soil discharge opening for gathering and discharging soil particles having a larger specific gravity in the front-end area of said separating plate, a discharge opening for grain having a smaller specific gravity in the rear end area of said separating plate, and an automatic control apparatus for said grain separator the control apparatus includes a photoelectric means comprising a light source for projecting a light ray to the front area of said separating plate and a light receiving element for detecting reflected rays from said separating plate, an electromagnetic driving means connected to an electric circuit of said light receiving element producing a signal in response to the intensity of the reflected rays, and a control means connected to said electromagnetic driving means for allowing or blocking the discharge of said grain at said soil discharge opening.

Therefore, this apparatus permits soil particles of unmixed purity to be precisely separated by a valve which operates in conjunction with a photoelectric means set in the front end of the separating plate to facilitate the separation of soil particles making re-separation unnecessary and thus promoting operating efficiency and saving labor. Precise separation of mixture of soil and grain, considered impossible in the prior art, may now be accomplished by this invention. Furthermore, with an automatic control apparatus, the operation itself is simplified.

A second object of this invention is to provide an automatic control apparatus for a grain separator in which the control means for allowing or blocking the discharge of said particles is a switching valve.

A third object of this invention is to provide an automatic control apparatus of a grain separator in which the control means for allowing or blocking discharge of said particles comprises the bottom plate of a discharge flue which vertically pivots about the discharge outlet disposed at the front end of said separating plate.

A fourth object of this invention is to provide an automatic control apparatus for a grain separator having a control means for allowing or blocking discharge of grain comprising a front switching valve and a rear switching valve, wherein the zone between said front switching valve and said rear switching valve forms a clear separating section, and wherein said separating plate provides a rough separating section beyond said rear switching valve. Both the front and rear switching valves are so operated that said front switching valve closes when said rear switching valve opens, and said front switching valve opens when said rear switching valve closes.

A fifth object of this invention is to provide an automatic control apparatus of a grain separator having an electromagnetic device control circuit which so actuates the switching valves that said front switching valve opens for a required amount of time to discharge the soil in said clear separating section while said rear switching valve closes, and said rear switching valve opens while said front switching valve is closed after the soil is discharged.

BEST MODE FOR CARRYING OUT THE INVENTION

Figure 1:
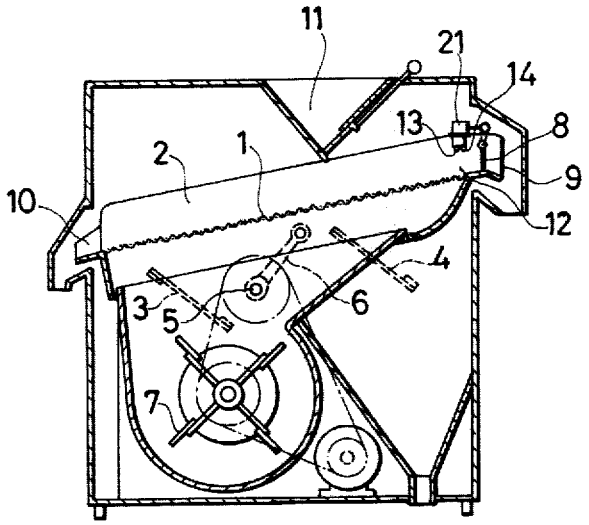
FIG. 1 is a vertical sectional view of the first embodiment.
Figure 2:
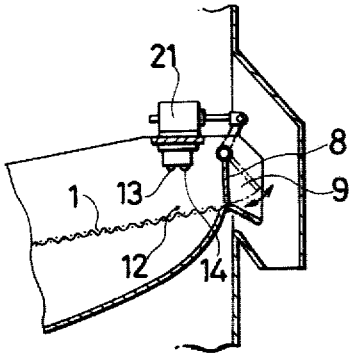
FIG. 2 is an enlarged vertical sectional view of the principal parts of the first embodiment.

FIGS. 1–4 show a grain separator, in which a separating frame 2 of a porous separating plate 1 is mounted so as to oscillate back and forth with a front end portion elevated across supporting links 3, 4 attached to the frame of said grain separator.

One side of the separating frame 2 is connected to a rod 6 of an eccentric means 5, and a blower 7 for separating materials is mounted to a shaft below the separating plate 1. A soil discharge opening 9, provided with a switching valve 8, is situated in the front end of the separating frame 2 and a grain discharge opening 10 is situated in the back end of the separating frame 2.

In this grain separator, having a grain supplying hopper 11 mounted over the separating plate 1, a reflective surface 12 of the separating plate 1 in the area of the discharge opening 9 is of brighter hue than the soil.

A light source, such as an incandescent lamp 13, is set over the reflective surface 12 to project the light thereon, and a light receiving element 14 is also set over the reflective surface 12 to receive reflected rays. A control circuit 15 of the light receiving element 14 is connected to an amplifier 16, and the amplifier 16 (see FIG. 3) is connected to a setter 17 for setting the amplification degree of the switching valve 8. The amplifier 16 is also connected through a transistor 18, a relay 19, and a timer 20 (FIG. 4) for regulating the opening time of the switching valve 8, to a solenoid 21 for operating said valve 8.

When a mixture of grain and soil is supplied from the grain supplying hopper 11 onto the separating plate 1, the grain spreads over the surface of separating plate 1, including the reflective surface 12. Assuming that soil particles are darker than both the surface of the separating plate and the grain, due to relatively intense reflected light rays from the plate surface and grain, a relatively strong signal is transmitted from the receiving element 14 to the solenoid 21 until the soil particles are collected and concentrated on the light reflective surface 12 so that the solenoid 21 shuts the switching valve 8 off. When, the darker soil particles of greater specific gravity are subsequently collected and concentrated on the reflective surface 12 dulling the reflected rays, the solenoid 21 opens the switching valve 8 to allow discharge of only the soil. According to the discharging condition, when the ratio of grain to soil is again increased on the reflective surface, the solenoid 21 again shuts the switching valve 8 so that discharging is prevented until enough soil particles are collected.

As mentioned above, the solenoid 21 operates in response to the amount of grain on the reflective surface, providing the intermittent switching operation of the valve 8.

Figure 3:
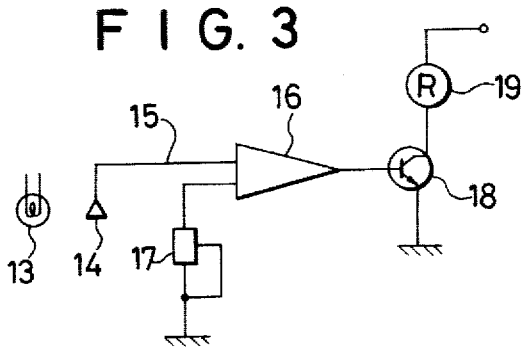
FIG. 3 is a diagram illustrating drive circuitry for controlling relay coil 19.
Figure 4:
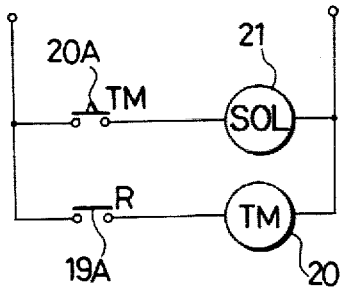
FIG. 4 is a two wire diagram of a circuit for driving gate 8 in response to relay coil 19.

Also, in this embodiment, as shown in FIGS. 3 and 4, the switching time of the switching valve 8 may be controlled with the setter 17 or the timer 20. In these figures, 19A designates a contact of relay 19, and 20A is a contact of timer 20.

Figure 5:
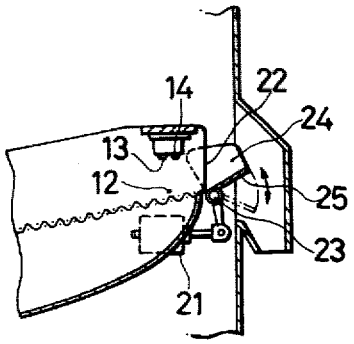
FIG. 5 is a vertical sectional view of the principal parts of the second embodiment.

FIG. 5 shows a second embodiment of the present invention, wherein a bottom plate 25 of a flue 24, operable upwardly and downwardly about a pivot 23, is projected from the front end of the soil discharge outlet 22 at a steeper inclination than the separating plate 1.

When current from the receiving element 14 drives the solenoid 21, the inclination of the bottom plate 25 is increased to completely prevent any discharge of the soil and grain.

When dark soil accumulates on the reflective surface 12 and attenuates the reflected rays, the solenoid 21 reduces the inclination of the bottom plate 25 and only the concentrated soil particles are discharged through the discharge flue 24. In this operation, the intermittent operation time and frequency depend on the ratio of the soil to the grain.

Figure 6:
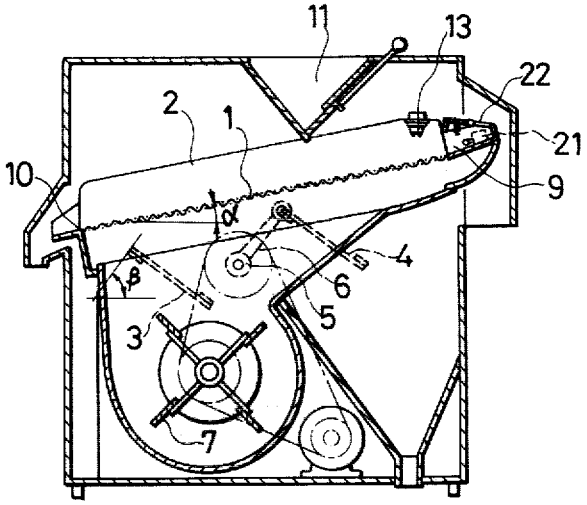
FIGS. 6–8 are enlarged vertical sectional views of the principal parts of the third embodiment.
Figure 7:
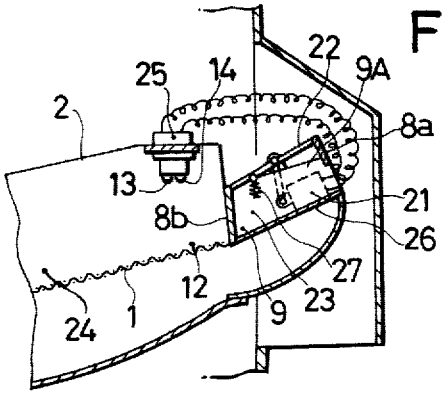
Figure 8:
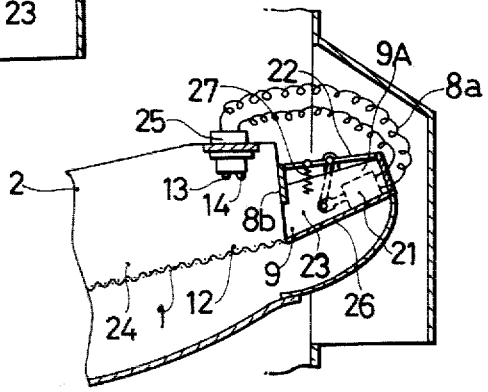

FIGS. 6–8 show a third embodiment of the present invention, wherein a porous separating plate 1 is inclined and mounted at a tilt angle ($\alpha$) in a front elevated position to the separation frame 2 below a grain supplying hopper 11, and the separation frame 2 is supported so as to oscillate back and forth by means of links 3, 4. A fulcrum of the link 4 is its point of connection with rod 6 of eccentric means 5; and a blower 7, for ventilating the porous wall of the separating plate 1, is mounted to a shaft in the lower part of the separating plate 1.

A grain discharge outlet 10 is disposed at the back of the separation frame 2 and a soil discharge outlet 9 is disposed at the front. A discharge flue 9A projects forward from the discharge outlet 9.

In the front end of the discharge outlet 9, a front switching valve **8*a* is provided for switching by a solenoid 21, and a rear switching valve 8*b*, operated counter to front valve 8*a* by link 22, is provided in the rear part of the discharge outlet 9**.

The discharge path between the switching valves **8*a* and 8*b* forms a cleaning section 23 and the discharge path of the separating plate 1 forms a rough separating section. A light source, such as an incandescent lamp 13, for projecting light onto a reflective surface 12, and a receiving element 14, for receiving the ray reflected from the surface 12 or from the mixed particles, are set toward the rear of the rear switching valve 8*b* to define a photoelectric means which is connected to a circuit control means 25**.

Grain blowing holes 26 are provided with the discharge flue 9A of the cleaning section 23. In some cases, blast pipes for blowing back the grain is provided separately. 27 a spring mounted on a link 22 and is so biased that the rear switching valve **8*b* closes when the front switching valve 8*a*** opens.

When mixtures such as cargo rice mixed with soil are supplied from the grain supply hopper 11 onto the separating plate 1, the grain and soil are separated due to their differing specific gravities, by the wind, into upper and lower layers. Oscillations carry the grain to the front of the separating frame 2 where it becomes distributed on the surface and rolls backward due to the flow of air and the inclination $\alpha$ of the separating plate 2 to be discharged from the rear grain discharge outlet 10.

A considerable amount of grain is still mixed with the remaining soil and concentrated in the front part of the separation frame 2. But when the soil is transferred through the opened valve **8*b* to the cleaning section 23, the grain, which is lighter than the soil, is fed back to the rough separation section 24 with the blast from the discharge flue (9A) to further purify the soil in the cleaning section 23**.

Thereafter, when the ratio of grain to soil on the reflective surface 12 reaches a certain limit, the intensity of reflected light is considerably decreased, so that upon detection by the light receiving element 14, the solenoid 21 of the control means 25 shuts the rear valve **8*b* and at the same time, the spring 27 moves the link 22 to open the front valve 8*a* so as to discharge only the soil. In some cases, a solenoid is set in each switching valve and a photoelectric means may be disposed facing the cleaning section 23**.

Figure 9:
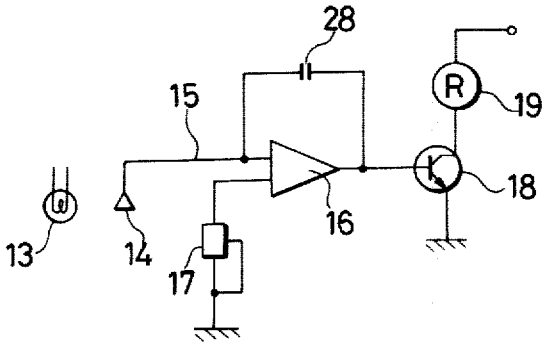
FIG. 9 is an another diagram of the control circuit.

FIG. 9 is another embodiment of an electric circuit which, according to this invention, is provided with a delay circuit containing a capacitor 28, instead of a timer 20 as in FIGS. 3 and 4.

The photoelectric means used in this invention is a device comprising a light source and a light receiving element, in other words, a photoelectric converting element which is designed for projecting light from a light source to the bottom surface of the cleaning section or to the mixture of soil and grain, and which receives the ray reflected therefrom with an element for detecting and signalling the purity of the mixture. The light source may include an incandescent lamp, a fluorescent lamp, a luminous diode, an arc lamp or the like and the receiving element may include photoelectric tube, a phototransistor, a photodiode, a selenium cell, a silicon solar cell, a photomultiplier, a telecamera tube, an image tube or the like.

Moreover, an electromagnet, a motor or similar device may be used as the electromagnetic driving means and the switching valve may include rotary and swing shutters.

If the surface of the front end area of the separating plate 1 is colored a shade different from that of the soil particles, for example, if the surface is colored a brighter shade than that of the soil particles, the receiving element receives a stronger reflected ray than when much soil is present and operates the driving means, whereby the switching valve is shut or the discharge flue is inclined at a sharp angle to prevent the forward flow of particles. For example, the dark soil particles of large specific gravity are collected at the front of the separating plate to increase the density of soil particles such that the proportion of grain contained in the soil approaches zero, so that when the intensity of the reflected ray decreases and reaches the lower limit, the receiving element 14 operates the driving means to open the valve in the soil discharge outlet or reduce the inclination of the discharge flue so as to discharge only the soil particles.

Grain appears at the front of the separating plate and decreases the density of soil particles, so that when the intensity of light received by the element 14 is increased and reaches an upper limit, the switching valve is again shut or the inclination of the discharge flue is again increased to prevent the flow of the mixture from the flue.

Accordingly, grain is discharged from the discharge outlet 9 disposed at the rear of the separating plate 1 so that soil and grain are separated at a high grade of purity.

In short, according to alterations of the hue of the reflective matter, the signal from the receiving element is applied to the electromagnetic driving means to control the discharge of soil from said separator. However, particles of different shades in this invention imply light of different wavelengths, or reflected rays of different flux. Therefore, a filter is usually set in front of the light source or the light receiving element, and the flux of the reflected ray or the intensity of light determines whether it is a bright or dark hue.

I claim:

1. In a grain separator having a separating plate inclined and supported at a front elevated position to separate a mixture of soil particles and grain particles having different shades and specific gravities and which is oscillated back and forth to collect sand soil particles, with a soil discharge particles opening for gathering and discharging soil particles of relatively large specific gravity disposed at a front end portion of said separating plate, a discharge opening for grain of smaller specific gravity at the rear end of said separating plate: an automatic control apparatus of said grain separator comprising a photoelectric means including a light source for projecting light rays to the front end portion of said separating plate and a light receiving element mounted in the front end portion of said separator plate for detecting the rays reflected from said separating plate, an electromagnetic driving means connected to the circuit containing said light receiving element generating a signal dependent on the intensity of the reflected rays and, a switching valve means connected to said electromagnetic driving means for selectively allowing or blocking discharge of said particles at said soil particles discharge opening.

2. An apparatus as claimed in claim 1, wherein the switching valve means for allowing or blocking the discharge of particles comprises a front switching valve and a rear switching valve, wherein a smooth surface zone between the front switching valve and rear switching valve forms a clear separating section, wherein said separating plate positioned behind said rear switching valve has a roughened surface to form a rough separating section, and wherein both the front and back switching valves define an alternate switching valve which operates in such a way that said front switching valve closes when said rear switching valve opens, and said front switching valve opens when said rear switching valve closes.

3. An apparatus as claimed in claim 2, including electromagnetic device driving means for opening said front switching valve for a required period of time to discharge said soil particles to said clear separating section while said rear switching valve is closed, and opening said rear switching valve while said front switching valve is closed, after the soil is discharged.

* * * * *